US008102117B2

(12) United States Patent
Christiansen

(10) Patent No.: US 8,102,117 B2
(45) Date of Patent: Jan. 24, 2012

(54) ISOLATION MASK FOR FINE LINE DISPLAY

(75) Inventor: Kirk Wegner Christiansen, Mesa, AZ (US)

(73) Assignee: World Properties, Inc., Lincolnwood, IL (US)

( * ) Notice: Subject to any disclaimer, the term of this patent is extended or adjusted under 35 U.S.C. 154(b) by 656 days.

(21) Appl. No.: 11/998,632

(22) Filed: Nov. 30, 2007

(65) Prior Publication Data

US 2009/0140649 A1 Jun. 4, 2009

(51) Int. Cl.
*H05B 33/02* (2006.01)

(52) U.S. Cl. ..... 313/506; 313/509

(58) Field of Classification Search ..... 313/498–512; 315/169.1, 169.3; 428/690–691, 917; 438/26–29, 438/34, 82; 257/40, 72, 98–100, 642–643, 257/759; 427/58, 64, 66, 532–535, 539; 445/24–25

See application file for complete search history.

(56) References Cited

U.S. PATENT DOCUMENTS

| | | | | |
|---|---|---|---|---|
| 3,184,635 | A | 5/1965 | O'Connell, Jr. | 315/71 |
| 3,201,633 | A | 8/1965 | Lieb | 428/201 |
| 4,816,717 | A | 3/1989 | Harper et al. | 313/502 |
| 5,508,585 | A * | 4/1996 | Butt | 313/509 |
| 5,686,792 | A * | 11/1997 | Ensign, Jr. | 313/509 |
| 6,307,528 | B1 * | 10/2001 | Yap | 345/45 |
| 6,411,726 | B1 | 6/2002 | Pires | 382/124 |
| 7,088,039 | B2 * | 8/2006 | Barnardo et al. | 313/510 |
| 7,842,356 | B2 * | 11/2010 | Ishikawa | 427/577 |
| 2002/0094451 | A1 * | 7/2002 | Li et al. | 428/690 |
| 2004/0043191 | A1 * | 3/2004 | Zovko | 428/138 |
| 2006/0008741 | A1 * | 1/2006 | Yin et al. | 430/311 |
| 2008/0057604 | A1 * | 3/2008 | Tanaka | 438/29 |
| 2008/0122351 | A1 * | 5/2008 | Kitazume | 313/504 |

FOREIGN PATENT DOCUMENTS

| | | |
|---|---|---|
| WO | WO/2005/015958 | 2/2005 |
| WO | WO/2006/072796 | 7/2006 |

* cited by examiner

*Primary Examiner* — Nimeshkumar Patel
*Assistant Examiner* — Donald Raleigh
(74) *Attorney, Agent, or Firm* — Cantor Colburn LLP

(57) ABSTRACT

An electroluminescent panel having a front electrode overlying a translucent sheet, a phosphor layer overlying the front electrode, a dielectric layer overlying the phosphor layer, and a rear electrode overlying the dielectric layer, the electroluminescent panel further includes a mask layer between the front electrode and the phosphor layer, wherein the mask layer is patterned to define graphics optically and electrically. A layer other than the mask layer can also be patterned.

10 Claims, 1 Drawing Sheet

ISOLATION MASK FOR FINE LINE DISPLAY

FIELD OF THE INVENTION

This invention relates to an electroluminescent (EL) lamp and, in particular, to an EL lamp having a mask layer between the phosphor and the front electrode.

GLOSSARY

As used herein, a "display" is a device that provides information in visual form to a viewer.

A "graphic" can be text, a symbol, an arbitrary shape, or some combination thereof. A graphic can be translucent, diffuse, sharp, shaded, colored, a silhouette or outline, or some combination thereof. Graphics can be positive (e.g. black on white) or negative (e.g. white on black).

As used herein, an EL "panel" is a single sheet including one or more luminous areas, wherein each luminous area is an EL lamp.

An "EL lamp" is a thick film, capacitive device including a layer containing electroluminescent phosphor between two electrodes. The phosphor is luminous when a voltage is applied to the electrodes.

A "thick film" EL lamp refers to one type of EL lamp and "thin film" EL lamp refers to a different type of EL lamp. The terms only broadly relate to actual thickness and actually identify distinct disciplines. A thin, thick film EL lamp is not a contradiction in terms and such a lamp is considerably thicker than a thin film EL lamp.

"Opaque" does not mean that no light is transmitted, only that the amount of light transmitted is substantially reduced, e.g. to ten percent of incident light. "Obscure" might be another term.

"Opacifier" is an agent added to a layer, causing it to obscure a graphic behind or under the layer. An opacifier can be black, white, or seen as color.

"Transparent" does not mean that all light is transmitted, only that enough light is transmitted to recognize a graphic.

A "phosphor" is not restricted to a single type of phosphor or dopant and does not exclude cascading phosphors or dyes for color enhancement.

BACKGROUND OF THE INVENTION

An EL lamp is essentially a capacitor having a dielectric layer between two conductive electrodes, one of which is transparent. The dielectric layer can include phosphor particles or there can be a separate layer of phosphor particles adjacent the dielectric layer. A modern (post-1985) EL lamp is typically made by depositing layers of inks on a substrate, e.g. by roll coating, spraying, or various printing techniques. The techniques for depositing ink are not exclusive, although the several lamp layers are typically deposited in the same manner, e.g. by screen printing. In the context of a thick-film EL lamp, and as understood by those of skill in the art, "inorganic" refers to a crystalline, luminescent material that does not contain silicon or gallium. The term does not refer to the other materials from which an EL lamp is made.

The inks used include a binder, a solvent, and a filler, wherein the filler determines the nature of the ink. As long known in the art, having the solvent and binder for each layer be chemically the same or chemically similar provides chemical compatibility and good adhesion between adjacent layers; e.g., see U.S. Pat. No. 4,816,717 (Harper et al.). It is not easy to find chemically compatible phosphors, dyes, binders, fillers, solvents or carriers and to produce, after curing, the desired physical properties, such as flexibility, and the desired optical properties, such as color and clarity.

EL phosphor particles are typically zinc sulfide-based materials, including one or more compounds such as copper sulfide ($Cu_2S$), zinc selenide (ZnSe), and cadmium sulfide (CdS) in solid solution within the zinc sulfide crystal structure or as second phases or domains within the particle structure. EL phosphors typically contain moderate amounts of other materials such as dopants, e.g., bromine, chlorine, manganese, silver, etc., as color centers, as activators, or to modify defects in the particle lattice to modify properties of the phosphor as desired. The color of the emitted light is determined by the doping levels. Although understood in principle, the luminance of an EL phosphor particle is not understood in detail.

It is known in the art to define a graphic by patterning a lamp layer; i.e., the front electrode, the phosphor layer, the rear electrode, or combinations thereof. The granular nature of the phosphor and the lambertian emission of light necessarily limit the resolution of a graphic. One solution known in the art is to place a graphic layer over an EL lamp. This has the advantage of potentially producing a high resolution display but has the disadvantages of cost and power consumption because one is lighting areas that are masked by the graphic. Using a patterned lamp layer and a graphic layer reduces power consumption but introduces problems of registration with the graphic layer, which increase the cost of the display.

It is known in the art to control field intensity between the electrodes of an EL lamp, and therefore brightness, by adding a dielectric (insulating) layer. U.S. Pat. No. 3,201,633 (Lieb) discloses phosphor regions having a high dielectric constant and other areas of low dielectric constant among the phosphor regions in a single layer. The areas may include light absorbing material. In another embodiment, the phosphor regions are embedded into a layer having a low dielectric constant, producing a reduced thickness portion of the layer between the phosphor and the front electrode. U.S. Pat. No. 5,508,585 (Butt) discloses adding a dielectric layer under the rear electrode to produce a graphic. U.S. Pat. No. 5,686,792 (Ensign, Jr.) discloses using a dielectric layer to elevate interconnects above the level of rear electrodes to make non-luminous interconnects. U.S. Pat. No. 6,411,726 (Pires) discloses a resin layer between the front electrode and the phosphor in an EL lamp. U.S. Pat. No. 7,088,039 (Barnardo et al.) discloses putting a dielectric layer under conductive runs to rear electrodes to reduce unwanted light emission. In a complex display, the routing of interconnects can be difficult and typically limits the design of a display, particularly for concentric, separately lit elements.

Published PCT application WO/2006/072796 (Tyldesley et al.) discloses an "intermediate" or "protective" layer between the ITO and the phosphor in an EL lamp. It is disclosed that "in the prior art display, the barium titanate in the dielectric layer can react with the Indium Tin Oxide (ITO) transparent electrode in some manner in the curing process to turn the ITO slightly yellow. In order to protect the ITO, the protective layer may be arranged to ensure separation of the dielectric material and the substantially transparent electrode during manufacture of the display." Curiously, it is also disclosed that "the performance of the display may be enhanced by including a small concentration of Barium Titanate in the intermediate layer." The disclosure of the published application is somewhat mysterious in that the intermediate layer "may" include a dye. It is disclosed that "An example of such a dye is X." None of this may be a problem for one trying to reproduce the disclosed invention because "the intermediate layer may be one that dissipates or otherwise disappears during the curing process."

It is known in the art that luminosity is non-linearly proportional to the voltage on an EL lamp. That is, in a perfectly dark chamber with suitable instruments, one could detect light emission from a phosphor at just a few volts. Such extreme conditions are irrelevant to this invention, which is not concerned with esoteric possibilities but is concerned with the perception of light under normal conditions of use for a portable electronic device. Thus, an area is perceived as "off" if a person with unaided normal vision cannot detect light emission under normal circumstances. For example, normal circumstances do not include careful inspection or unusual darkness.

In the market for displays, there is a continuing demand for greater flexibility, greater clarity, lower power consumption, and, especially, lower cost. Taken for granted are many other considerations, such as brightness, environmental stability (can endure high temperature and high humidity or low temperature), electrical stability, and low noise (electrical or acoustic). Such a market is a continuously moving target and difficult to satisfy.

In view of the foregoing, it is therefore an object of the invention to provide an EL panel having high resolution graphics and low cost.

Another object of the invention is to provide an EL panel that simplifies the production of complex graphics for display.

A further object of the invention is to provide an EL panel with minimal stray light emission.

Another object of the invention is to provide an EL panel that provides high resolution graphics without patterning at least one electrode.

A further object of the invention is to provide an EL panel that has low power consumption despite the use of a mask over areas of phosphor.

Another object of the invention is to provide an EL panel that displays graphics and is characterized by simplicity of design, both optically and electrically.

A further object of the invention is to provide an EL panel that displays graphics characterized by fine line geometries.

Another object of the invention is to provide an EL panel that displays high resolution graphics including separately addressable, concentric areas.

SUMMARY OF THE INVENTION

The foregoing objects are achieved by this invention in which an electroluminescent panel having a front electrode overlying a translucent sheet, a phosphor layer overlying the front electrode, a dielectric layer overlying the phosphor layer, and a rear electrode overlying the dielectric layer, said electroluminescent panel further includes a mask layer between the front electrode and the phosphor layer, wherein the mask layer is patterned to define graphics optically or optically and electrically. A layer other than the mask layer can also be patterned.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
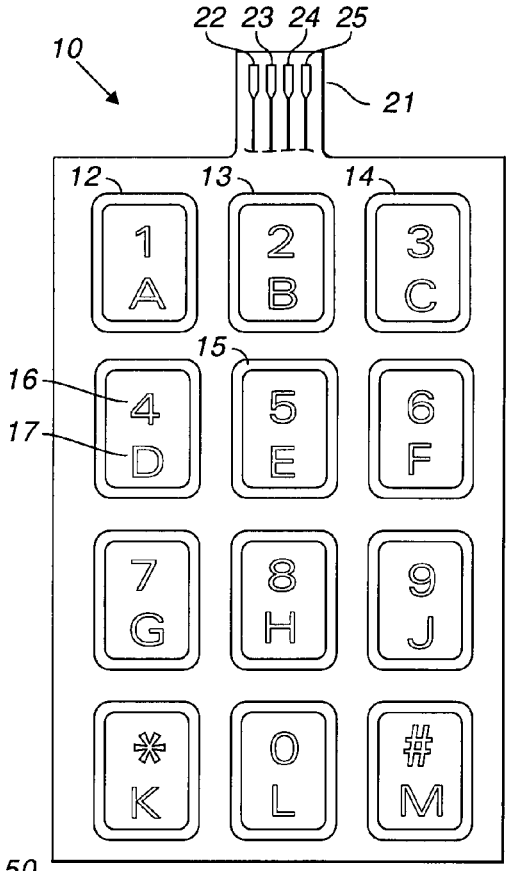
FIG. 1 is a plan view of a keypad constructed in accordance with the invention.

FIG. 1 is a plan view of a keypad constructed in accordance with the invention. In FIG. 1, EL panel 10 includes a plurality of lit perimeters or frames, such as frames 12, 13, 14, and 15. Within a frame and enclosed by a frame is a numeral, such as numeral 16, and a letter, such as letter 17. In one embodiment of the invention, the frames are turned on or off simultaneously as a group. Independently of the frames, the numerals are turned on or off as a group. Independently of either the frames or the numerals, the letters are turned on or off as a group.

Figure 2:
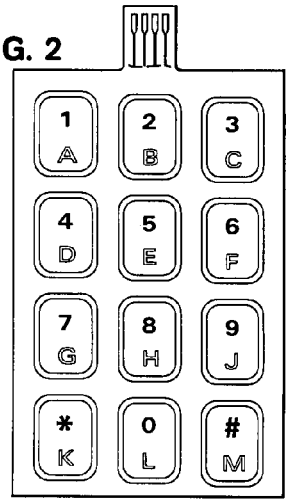
FIG. 2 is a plan view of a keypad selectively illuminating numerals.
Figure 3:
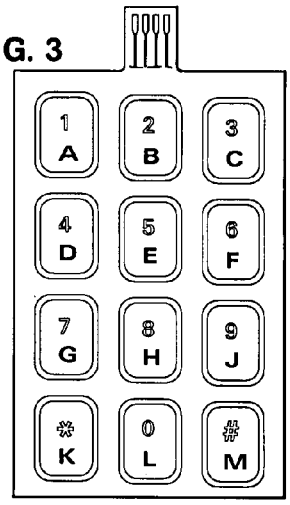
FIG. 3 is a plan view of a keypad selectively illuminating letters.
Figure 4:
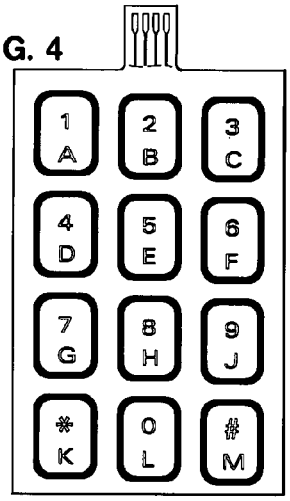
FIG. 4 is a plan view of a keypad selectively illuminating perimeters.

Independent operation is obtained by coupling the lit areas to separate leads in connector 21. For example, the frames are coupled to lead 22, the numerals are coupled to lead 23, the letters are coupled to lead 24 and common is coupled to lead 25. FIG. 2 illustrates a keypad with only the numerals lit. FIG. 3 illustrates a keypad with only the letters lit. FIG. 4 illustrates a keypad with only the frames lit. All groups can be turned on or off together, if desired, or in various combinations.

In accordance with a preferred embodiment of the invention, lamp design is simplified and costs are reduced by including a mask layer between the phosphor and the front electrode. One can produce fine line geometries because the mask includes an opacifier that has much finer grain than the phosphor. By relying on the mask, one is relieved from trying to print fine lines in phosphor or conductive inks. Although one can pattern the front electrode, this is not necessary with the invention and the cost of producing a patterned front electrode is saved.

One embodiment of the invention used Asahi CR-18A-CK ink containing polyester resin as a binder and carbon as a filler. The mask layer appears to be black. The ink is commercially available from Asahi Chemical Research Laboratory Co., Ltd. With this material as a mask, for example, six point Helvetica type ($_{qwerty}$) is clear and legible, even in lowercase.

Figure 5:
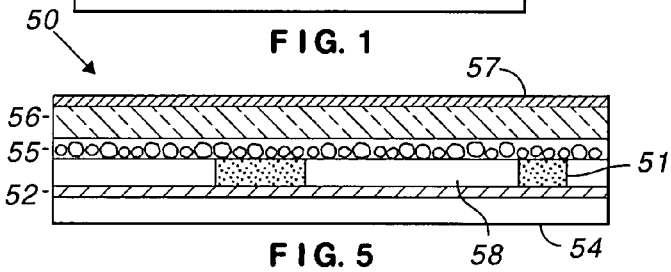
FIG. 5 is a cross-section of an EL panel constructed in accordance with a preferred embodiment of the invention.

FIG. 5 is a cross-section of an EL panel constructed in accordance with a preferred embodiment of the invention. The construction of EL panel 50 is conventional except for the addition of mask layer 51. EL panel 50 includes front electrode 52 overlying transparent substrate 54. Phosphor layer 55 overlies mask layer 51 and dielectric layer 56 overlies phosphor layer 55. Rear electrode 57 overlies dielectric layer 56. The layers can be roll coated, screen printed, or otherwise deposited as an ink that cures or dries. Front electrode 52 is preferably a sputtered layer of ITO. Patterned layers are preferably screen printed.

Mask layer 51 is preferably screen printed using an ink suitable for producing the desired result. Mask layer 51 is patterned to define graphics optically, by light absorption, and electrically, by reducing light emission from phosphor layer 53 in the region of the mask. Light is emitted from area 58, for example.

Mask layer 51 serves at least three functions, optical, electrical, and aesthetic. Optically, mask layer 51 blocks stray light and defines a graphic. The opacity of the mask layer depends upon the desired visual effect and upon the dielectric strength of the layer. There is a balance, readily determined empirically, between providing a sufficiently thick or sufficiently loaded film for opacity and providing a film that is not too conductive, e.g. when carbon is used as the filler. The resin alone provides some reduction of luminosity because the electric field is reduced across the phosphor at the location of the mask, electrically isolating the phosphor. Adding carbon further reduces luminosity, because light is absorbed, but increases conductivity, which will slightly increase luminosity. If a customer wants reduced brightness, but not black, then less carbon can be used. Although reference is made herein to carbon, any coloring material can be used, such as dye or fluorescent material.

As illustrated in FIG. 5, a "flood" rear electrode, i.e. a screen printed or roll coated rear electrode that covers the panel, is used. Similarly, a flood phosphor layer is used. If the total lit area is much less than the total area of the display, one can reduce the cost of materials by patterning either the rear electrode or the phosphor layer and provide a complementary pattern to the mask layer. Individual rear electrodes in a patterned rear electrode layer enable one to address EL lamps individually in a panel. If phosphors of different colors are used, the phosphor layer is patterned.

Figure 6:
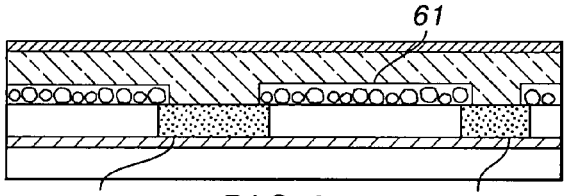
FIG. 6 is a cross-section of an EL panel constructed in accordance with an alternative embodiment of the invention.

As illustrated in FIG. 6, a mask layer is used for defining graphics, even though the phosphor layer is patterned. For example, phosphor region 61 is wider than the space between mask regions 63 and 64. More generally, the boundary of the graphic as defined by the phosphor lies underneath the mask. In this way, the mask layer defines the lit area. Also, by having the region of phosphor extend under the edges of the mask, registration problems are eliminated. The mask layer provides ease of design of graphics without complex rear electrode patterns or bus patterns. One can have lit areas (icons) exactly where one wants in a simple manner. Concentric areas can be individually addressable using a patterned rear electrode and the interconnects disclosed in the '792 patent, for example. The image is sharper than using only patterned layers without the mask layer.

Figure 7:
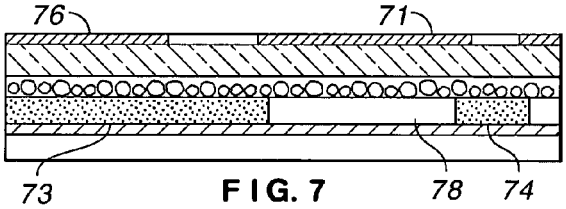
FIG. 7 is a cross-section of an EL panel constructed in accordance with an alternative embodiment of the invention.

As illustrated in FIG. 7, a mask layer is used for defining graphics, even though the rear electrode is patterned. For example, portion 71 of the rear electrode is wider than the space between mask regions 73 and 74. More generally, the boundary of the graphic as defined by the rear electrode lies underneath or behind the mask, when the panel is viewed normally. In this way, the mask layer defines lit area 78. Also, the image is sharper simply because the mask is closer to the phosphor than the rear electrode. Interconnects to rear electrodes are covered by the mask and are not seen. For example, interconnect 76 is hidden by mask region 73.

The invention thus provides an EL panel having high resolution, fine line graphics and low cost. High resolution graphics can be obtained without patterning other layers of the panel. The mask layer simplifies the design and production of is complex graphics for display, including separately addressable, concentric graphics, and minimizes stray light emission. Power consumption is reduced because a smaller area of phosphor is activated.

Having thus described the invention, it will be apparent to those of skill in the art that various modifications can be made within the scope of the invention. For example, one can pattern both the phosphor layer and the rear electrode layer with the graphics optically defined by the mask layer.

What is claimed is:

1. An electroluminescent panel having a front electrode overlying a translucent sheet, a phosphor layer overlying the front electrode, a dielectric layer overlying the phosphor layer, and a rear electrode overlying the dielectric layer, said electroluminescent panel further characterized in that:

an opaque mask layer is between the front electrode and the phosphor layer, wherein the mask layer is patterned to block stray light and define graphics.

2. The electroluminescent panel as set forth in claim 1 wherein the graphics are defined optically by the mask layer.

3. The electroluminescent panel as set forth in claim 1 wherein the graphics are defined optically and electrically by the mask layer.

4. The electroluminescent panel as set forth in claim 1 wherein the rear electrode has a pattern of graphic areas corresponding with at least some of the graphics in the mask layer.

5. The electroluminescent panel as set forth in claim 4 wherein the boundary of a graphic defined by the rear electrode lies underneath the mask, whereby the mask defines the appearance of the graphic.

6. The electroluminescent panel as set forth in claim 4 wherein interconnects to the rear electrodes of the graphic areas are hidden by the mask layer.

7. The electroluminescent panel as set forth in claim 1 wherein the mask layer includes an opacifier that has finer grain than the phosphor in said phosphor layer, thereby enabling the graphics to include fine lines.

8. The electroluminescent panel as set forth in claim 1 wherein the mask layer includes particles of carbon.

9. The electroluminescent panel as set forth in claim 1 wherein the phosphor layer has a pattern of graphic areas corresponding with at least some of the graphics in the mask layer.

10. The electroluminescent panel as set forth in claim 9 wherein the boundary of a graphic defined by the phosphor lies underneath the mask, whereby the mask defines the appearance of the graphic.

* * * * *